United States Patent [19]

Showalter

[11] Patent Number: 4,527,774

[45] Date of Patent: Jul. 9, 1985

[54] SPHERICAL VALVE LOCK-VALVE SPRING RETAINER ASSEMBLY TO MINIMIZE VALVE GUIDE SIDE LOADS

[75] Inventor: Merle R. Showalter, Madison, Wis.

[73] Assignee: Automotive Engine Associates, Madison, Wis.

[21] Appl. No.: 502,575

[22] Filed: Jun. 9, 1983

[51] Int. Cl.[3] ..... F16K 31/44

[52] U.S. Cl. ..... 251/337; 123/90.65

[58] Field of Search ..... 251/337; 123/90.44, 123/90.6, 90.65

[56] References Cited

U.S. PATENT DOCUMENTS

| | | | |
|---|---|---|---|
| 2,065,794 | 12/1936 | Colwell | 251/337 |
| 3,033,518 | 5/1962 | Sampietro | 251/337 |
| 3,273,856 | 9/1966 | Tauschek | 251/337 |
| 3,612,016 | 10/1971 | Jelen | 251/337 |
| 3,937,249 | 2/1976 | Suey | 251/337 |

*Primary Examiner*—A. Michael Chambers

*Attorney, Agent, or Firm*—Witherspoon & Hargest

[57] ABSTRACT

A valve lock-valve spring retainer assembly where the valve lock and valve retainer mating surfaces are spherical. The spherical valve lock-valve spring retainer mating surface permits small rotations of the valve spring retainer with respect to the plane perpendicular to the valve stem. This significantly reduces valve spring generated side loads on the valve guides.

2 Claims, 2 Drawing Figures

SPHERICAL VALVE LOCK-VALVE SPRING RETAINER ASSEMBLY TO MINIMIZE VALVE GUIDE SIDE LOADS

BACKGROUND AND OBJECTS

The friction between valve guide and valve stem is essentially Coulomb friction, so that friction is proportional to the side loads between these parts. In addition, minimization of valve stem side loads on the valve guide will act strongly to reduce wear of the valve guide in service. It is, therefore, desirable to reduce the side loads due to asymmetric loading of the spring with respect to the valve spring retainer.

The coil springs which operate in engines do not put their loads on the valve spring retainer uniformly, and it is not practical to manufacture them so that they do. However, if the valve spring retainer is free to rotate to a small degree out of perpendicular to the valve guide, it can adjust so as to essentially eliminate torques and side loads on the valve guide due to this imperfection in the coil spring. This can be done with a spherical valve lock-valve spring retainer arrangement as follows.

IN THE DRAWINGS

DETAILED DISCUSSION

Figure 1:
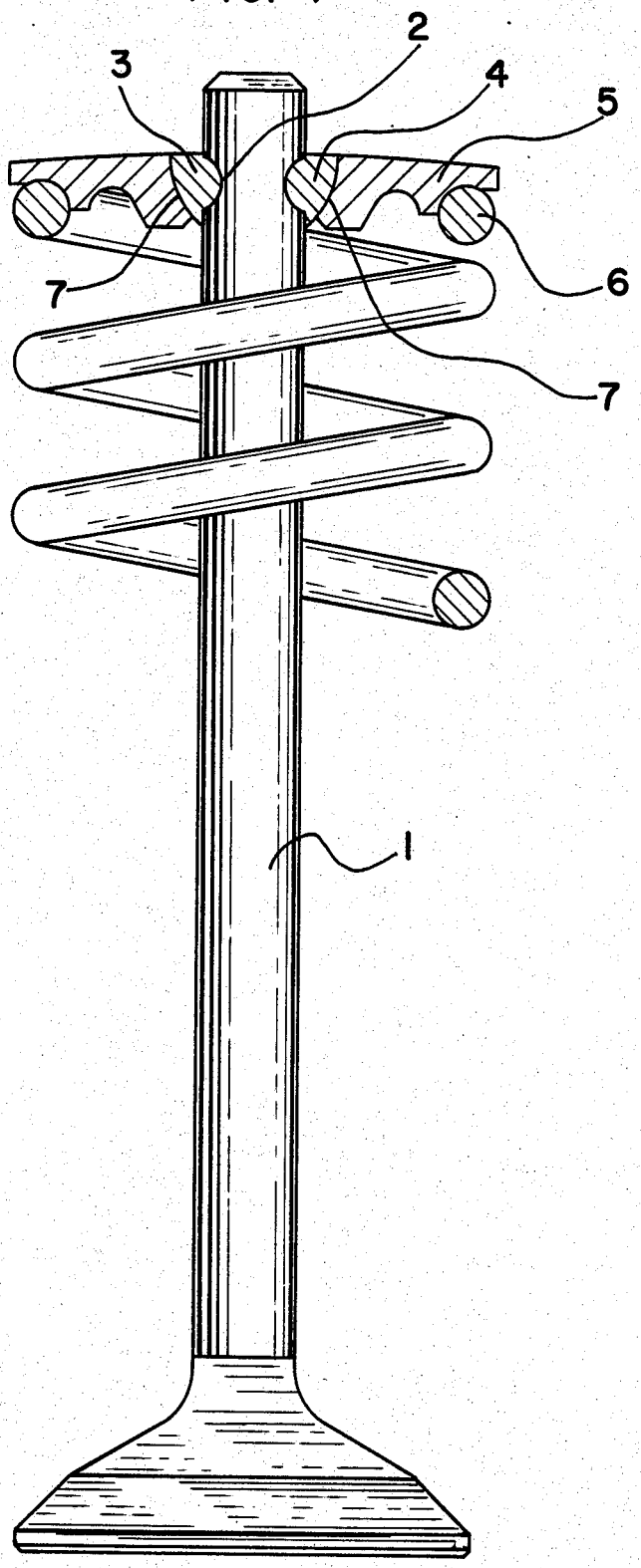
FIG. 1 shows a view of a conventional engine valve equipped with a coil spring with the valve lock and valve spring retainer assembly of the present invention shown in central cross section.
Figure 2:
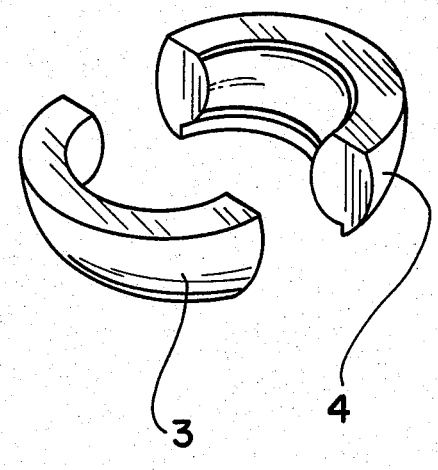
FIG. 2 is an isometric view of the valve locks equipped with a smooth spherical outward surface.

See FIG. 1. Poppet valve 1 has retainer engaging groove 2 designed in a conventional fashion. This valve stem groove is engaged by valve locks 3 and 4 which serve to lock valve spring retainer 5 which retains compressed spring 6. The mating surface between valve locks 3, 4 and retainer 5 are spherical surfaces shown by lines 7. These mating surfaces should be as near to spherical as possible, and preferably be as smooth as possible. On assembly, the surface of the spherical engaging surface of the valve retainer should be covered with a heavy oil soluble grease. During the assembly process, the spring invariably puts a nonuniform force on the retainer around the circumference of the retainer. Because of the spherical mating surface 7, the retainer will be free to rotate to minimize the moment that the spring places on the valve retainer 5. Minimizing this moment correspondingly minimizes the moment and resultant side loads placed on the valve guide by the coil spring. The reduction of these moments will reduce valve guide wear and valve actuating friction.

It is claimed:

1. A poppet valve having a stem, in combination with means on the valve stem end portion away from the valve for mounting a valve spring retainer wherein said retainer is free to tilt out of perpendicularity with regard to the lengthwise axis of the valve stem end portion, locking means mounted on the stem end away from the valve, said locking means having a curved portion engaging a matingly configured surface on the retainer for holding the valve spring retainer in operative position and allowing the retainer to tilt relative to said locking means and about the axis of the valve stem.

2. The invention as set forth in claim 1 and wherein said curved portion of the locking means engaging and holding the valve spring retainer is of spherical configuration and cooperates with a similarly shaped surface on the valve spring retainer.

* * * * *